United States Patent [19]

Shepherd

[11] 4,091,634

[45] May 30, 1978

[54] CRYOGENIC DEVICE WITH HEAT INPUT MEANS

[76] Inventor: Maurice William Shepherd, Quaint Ways, Bishopstone, Salisbury, England

[21] Appl. No.: 708,982

[22] Filed: Jul. 27, 1976

[30] Foreign Application Priority Data

Jul. 30, 1975 United Kingdom ..... 31817/75

[51] Int. Cl.[2] ..... F17C 7/02

[52] U.S. Cl. ..... 62/45; 62/55; 62/514 R

[58] Field of Search ..... 62/45, 50, 51, 514 R, 62/55

[56] References Cited

U.S. PATENT DOCUMENTS 2,304,488 12/1942 Tucker ..... 62/50

2,515,835 7/1950 Preston ..... 62/50

*Primary Examiner*—Ronald C. Capossela

*Attorney, Agent, or Firm*—Holman & Stern

[57] ABSTRACT

Cryogenic apparatus comprises the combination of an insulated Dewar container for cryogenic liquid and a probe-like device for the introduction of heat into the liquid, the device being of elongated form, increasing in cross-section from an upper, heat-input end towards a lower, heat-output end. The device may be of copper and substantially conical whereby its cross-section is substantially circular. The heat-input end of the device has an upper extension which penetrates a low-loss self-venting cover-plug disposed in the neck of the insulated container. A metallic "cold" plate is attached to the upper end of the extension and provides a large-area surface over which cold is distributed by convection.

10 Claims, 9 Drawing Figures

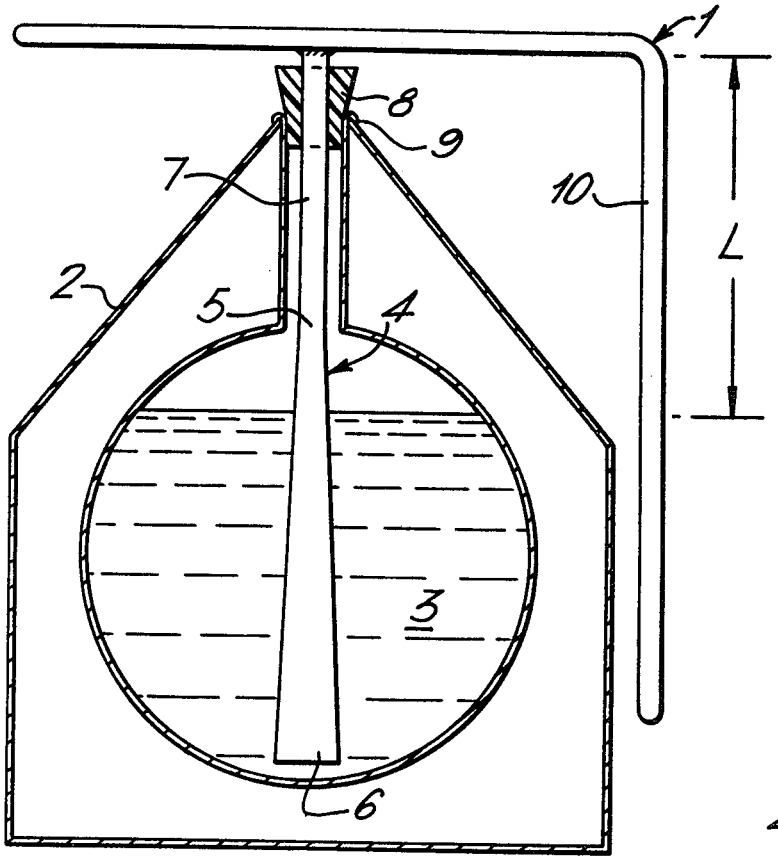
FIG.1.
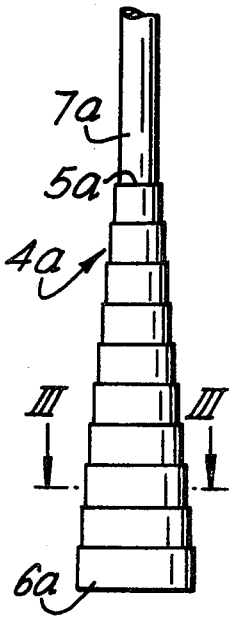
FIG.2.
FIG.3.
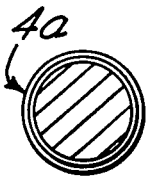
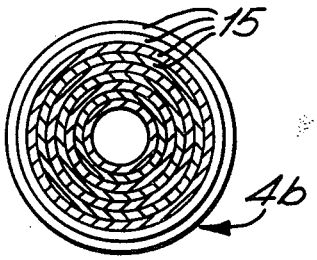
FIG.4.

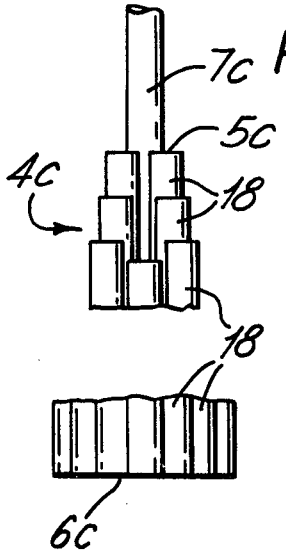
FIG.5.
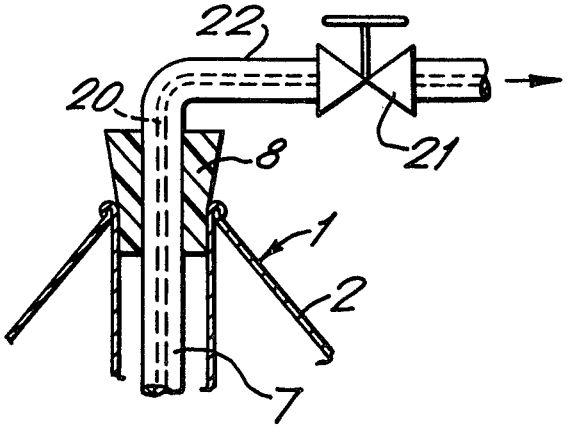
FIG.6.
FIG.7.
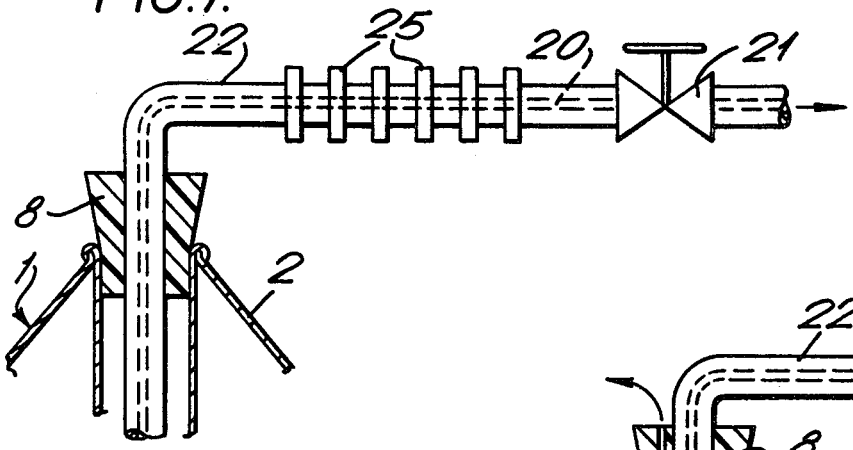
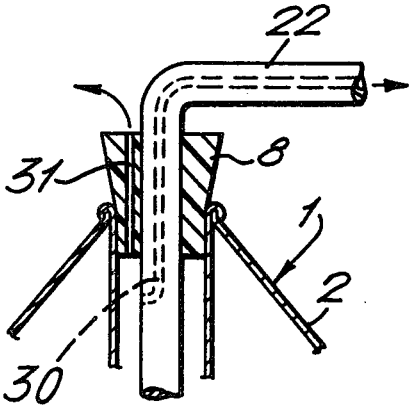
FIG.8.

CRYOGENIC DEVICE WITH HEAT INPUT MEANS

BACKGROUND TO THE INVENTION

This invention relates to cryogenic devices and apparatus and is concerned with the introduction of heat into cryogenic matter for various purposes, for example, cooling or refrigeration.

SUMMARY OF THE INVENTION

According to one aspect of the invention, a cryogenic device for introducing heat into cryogenic matter comprises a member of elongated form for insertion in the cryogenic matter, said member increasing in cross-section from the heat-input end of the member towards the heat-output end thereof.

According to another aspect of the invention, a cryogenic device for introducing heat into cryogenic matter comprises a member of elongated form for insertion in the cryogenic matter, said member being formed so that heat is introduced into the matter at a controlled rate.

Preferably said controlled rate is substantially uniform.

According to yet another aspect of the invention, cryogenic apparatus comprises the combination of a container for cryogenic matter and one of said members for introducing heat into said matter.

The heat introduced into the cryogenic matter may be used for cooling or refrigeration.

According to yet another aspect of the invention, a method of introducing heat into cryogenic matter comprises the use of one of said members or said cryogenic matter.

BRIEF DESCRIPTION OF THE DRAWINGS

The various aspects of the invention will now be described by way of example, with reference to the accompanying drawings, wherein:

FIG. 1 is a side view, in medial section, of cryogenic apparatus,

FIG. 2 is a side view of a modified form of the cryogenic device shown in FIG. 1, FIG. 3 is a section of said cryogenic device, taken on the lines III — III of FIG. 2, FIG. 4 is an enlarged view similar to FIG. 3, and illustrates another modification of said cryogenic device, FIG. 5 is a fragmentary side view of yet another modification of said cryogenic device, and FIGS. 6, 7 and 8 are fragmentary side views, and FIG. 9 a side view in medial section, of various modifications.

In the figures, like reference numerals refer to like components.

DESCRIPTIONS OF THE PREFERRED EMBODIMENTS

Figure 9:
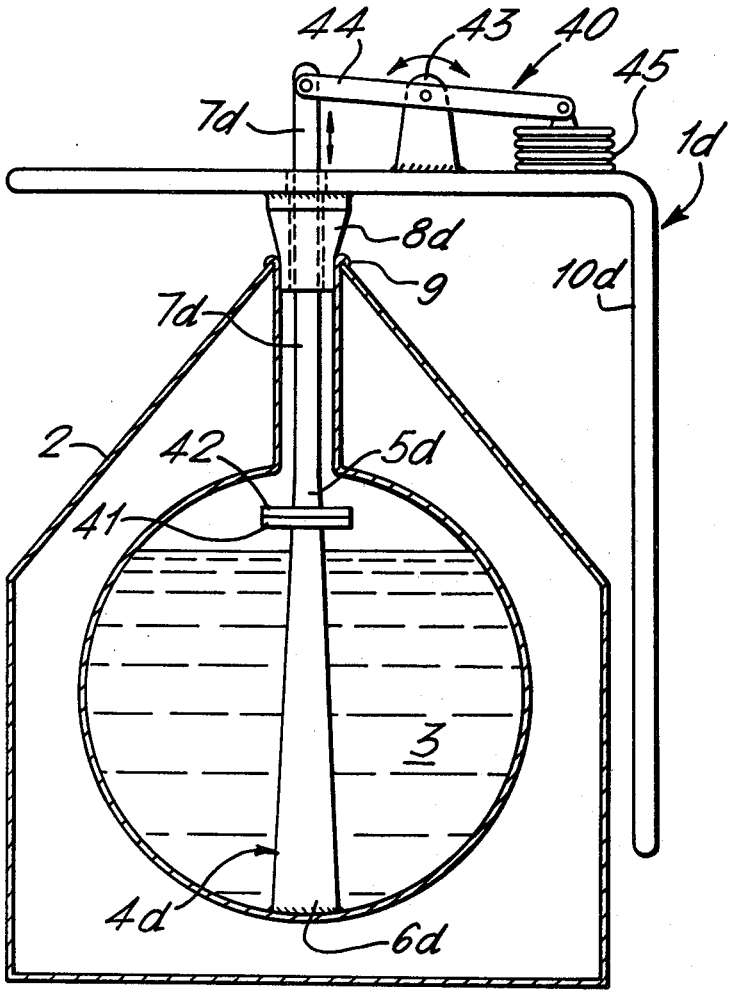

With reference to FIG. 1, cryogenic apparatus 1 comprises the combination of an insulated container 2 for cryogenic matter in the form of a charge of liquid nitrogen 3, and a device for the introduction of heat into the liquid nitrogen 3, said device comprising a probe-like thermal-conducting member 4 of elongated form inserted in said nitrogen, said member 4 having a substantially uniform taper increasing in cross-section from a heat-input end 5 of the member 4 towards a heat-output end 6 thereof.

In further detail, the insulated container 2 is a double-walled Dewar (or other) form of insulated flask. The elongated member 4 is of copper and is substantially conical whereby its cross-section is substantially circular. The heat-input end 5 of the member 4 has an extension 7 of substantially uniform cross-section which penetrates a low-loss self-venting cover-plug 8 of (preferably) plastics material disposed in the neck 9 of the insulated container 2. Free venting of nitrogen gas is provided for by ensuring side clearance between the extension 7 and surrounding parts of the plug 8.

An "L"-shaped "cold" plate 10 of metal is attached to the upper end of the extension 7. The plate 10 provides an external structure having a large-area surface over which cold is distributed by convection. The large-area surface of the "cold" plate 10 may be increased by making it of corrugated form or by providing it with cold-distributing fins.

The quantity Q of heat from the ambient surroundings which is conducted along the member 4 and into the liquid nitrogen 3 is given by the formula:

$Q = A/L \cdot k \cdot dt$, where:

$A$ = Cross-sectional area of the member 4 at the surface of the liquid nitrogen.

$L$ = Non-immersed length of member 4 and extension 7, (see FIG. 1).

$k$ = Mean thermal conductivity of member 4 and extension 7.

$t$ = Temperature difference between upper end of extension 7 and liquid nitrogen 3.

It will be readily appreciated that length L increases as the level of liquid nitrogen falls. However, the uniformly increasing cross-section of the member 4 results in the ratio $A/L$ remaining substantially constant. In a sense therefore, the level of liquid nitrogen 3 is effectively maintained. Thus, the form of the member 4 ensures that heat from ambient surroundings is introduced into the liquid nitrogen 3 at a substantially uniform (and controlled) rate.

Heat is thereby extracted, by convection, from ambient surroundings and introduced, via the "cold" plate 10, into the liquid nitrogen. The novel form of the elongated member ensures that this extraction of heat from ambient surroundings results in a substantially uniform and controlled degree of refrigeration, which continues until the charge of liquid nitrogen 3 is substantially exhausted.

Although the preferred form of elongated member 4 is substantially or generally conical, or rather frusto-conical, other shapes may be used, for example, pyramidal or wedge. The member 4 may also be of star-shaped cross-section. Still different shapes may be employed, but the uniformity of heat flow may not be as good.

Thus, with reference to FIGS. 2 and 3, an elongated member 4*a* may be used which is generally frusto-conical, but is formed with steps instead of with a substantially uniform taper. Current experiments indicate that the depth of each step is preferably not greater than 10% of the length of the member 4*a*, i.e. the distance between ends 5*a* and 6*a*.

FIG. 4 illustrates another modified form of elongated member. Here the member 4*b* comprises a co-axial nest of close-fitting tubular elements 15 of differing and increasing length. A side view of the member 4*b* would be identical to that shown by FIG. 2.

FIG. 5 illustrates yet another modified form of elongated member. Here the member 4*c* comprises a close-packed cluster or bundle of elements comprising rods 18, with the number of rods (which are of differing length), increasing from end 5c to 6c. The rods may be solid or tubular.

Still further forms of elongated member may be possible. For example, it may be desirable to provide the member with a profile which results in at least one controlled increase or decrease in heat flow when the level of liquid nitrogen 3 falls to a predetermined level or levels, or to provide one or more "dwell" periods of heat transfer.

Control can also be improved or varied by the use of materials of differing thermal conductivity, for example, an elongated member can be part copper and part stainless steel. With reference to the abovementioned formula, $Ak/L$ should remain substantially constant.

In the case of elongated members, at least part of which are hollow, as shown in FIGS. 4 and 5, control can be obtained by variation in wall thickness of one or more of the tubular elements.

Additional control can also be obtained by making at least one part of an elongated member movable relative to another part thereof, for example, by making at least one of the tubular elements 15 of FIG. 4 movable relative to an adjacent element in a telescopic manner. This movement can provide "fine" control or adjustment of heat introduction and the desired relative movement can be controlled by means external the flask 2.

The member 4 may also comprise upper and lower parts, with the upper part movable into and out of thermal contact with the lower part by temperature-sensitive means, for example, the thermal control arrangement 40 illustrated in FIG. 9, described hereinafter. In this modification, the lower part of the member is supported by the bottom portion of the inner wall of the container 2.

The apparatus 1 may be housed in a box, preferably of insulated construction, so that it may be used to refrigerate any substances or articles placed in the box. Such an arrangement is inexpensive and may be used on picnics or in caravans to keep foodstuffs fresh, or in hospitals, to store cultures etc.

The apparatus 1 may also be used to maintain a low temperature in a domestic freezer or a commercial cold chamber. The inexpensive apparatus may be so used either permanently (when no power source is required or is available), or as a portable emergency unit to be brought into service should the refrigerating plant of the freezer or cold chamber break down or fail to receive its supply of electrical power. Thus the need to transfer perishable goods to another freezer or cold chamber whilst time-consuming repairs to its refrigerating plant are carried out, can be avoided.

As the invention avoids the need for sophisticated (and expensive) control equipment, it also has particular use as an inexpensive refrigerating unit in refrigerated transport vehicles, for example, trans-continental road vehicles. Another use comprises the controlled freezing of specimens, for example, medical specimens. Yet another use comprises the generation and maintenance of a reduced temperature environment for bodies of deceased person exhibited in coffins prior to burial. A discrete way of achieving this this is to fit a flat "cold" plate in the bottom of a coffin so as to be covered by the body, and to dispose the container 2 beneath the coffin where it can be hidden by draping. A detachable connection is best provided between the cold plate and the container so that the container can be removed without disturbing the deceased, when the coffin is taken away for burial. The detachable connection may comprise a simple socket formed in the cold plate so as to receive the upper end of the extension 7 with small clearance.

With reference now to FIG. 6, the "cold" plate 10 may be dispensed with and the elongated member 4 (or one of its modifications) may be provided with an outlet passageway 20 extending axially through the member 4 from the (bottom) end 6 thereof.

This modification, which requires a good seal between the extension 7 and plug 8, can be used for decanting nitrogen and, as shown in FIG. 6, a flow control valve 21 and discharge duct 22 may be fitted to the top of the extension 7 to control and direct the flow of escaping nitrogen.

This modification may also be used in cryosurgery, for example, with a cryoprobe for freezing parts of the human body.

As liquid enters the bottom of the elongated member 4 to pass upwardly through the passageway 20, any slight impurities which may be present on the inner wall of the flask 2 will not accompany the outward flow of nitrogen.

With reference to FIG. 7, if required, an external evaporator 25 may be fitted in the duct 22 so as to raise the temperature of outflowing gas. External heat may be applied to the evaporator 25 if desired. The evaporator 25 shown comprises an externally finned tube.

This modification is particularly suitable where a relatively warm flow of gas is required, for example, to drive machinery.

With reference to FIG. 8, gaseous nitrogen can be allowed to escape from the container 2 by way of a passageway 30 which only extends part-way through the member and which has a laterally-extending inlet above the level of liquid nitrogen. Alternatively, the gas can be tapped off from a passageway 31 extending through the plug 8.

With reference to FIG. 9, in the modification illustrated therein, cryogenic apparatus 1d is provided with a thermal control arrangement 40.

The apparatus 1d has the member 4d in two parts, namely an upper part 7d movable into and out of thermal contact with a lower part 6d attached to and supported by the inner wall of the container 2. Adjacent ends of the parts 6d, 7d carry metal contact plates 41, 42 which normally abut in face-to-face contact, as shown.

In this modification, provision is made for free movement of the part 7d relative to the plug 8d, (which now serves as a guide for the part 7d), as well as plate 10d.

A fulcrum 43 is attached to the upper surface of the plate 10d. A lever 44 is pivotally supported by the fulcrum 43. One end of the lever 44 is pivotally attached to the part 7d and the other end thereof is pivotally attached to the upper end of a temperature-sensitive bellows 45, also attached to the upper surface of the plate 10d. The bellows 45 is sensitive to changes in temperature of the plate 10d.

In operation, should the temperature of the plate 10dfall unduly, the bellows 45 contracts to rotate the lever 44 clockwise. (As viewed in FIG. 9). Movement of the lever 44 causes the upper part 7d of the member 4d to be withdrawn from thermal contact with the lower part 6d thereof, thus interrupting the refrigeration process.

As the plate 10d warms up the bellows 45 expands, so as to rotate the lever 44 anti-clockwise (as seen in FIG. 9), whereby thermal contact between the parts is remade, and the refrigeration process recommenced.

I claim:

1. A cryogenic apparatus comprising a heat-insulated container defining a space for housing cryogenic matter, a heat-conducting member of elongated form disposed within the container, said elongated member having a heat-input end and a heat-output end, and heat conducting means for conducting heat from the ambient atmosphere to the heat-input end of the elongated member, said elongated member having a lateral cross-section which increases from the heat-input end of the member towards the heat-output end thereof, whereby ambient heat is introduced into any cryogenic matter present in the container, and at a substantially uniform rate.

2. The cryogenic apparatus of claim 1, wherein said heat conducting means includes a thermally-conducting structure disposed externally of the container so as to be exposed to ambient atmosphere, said structure being thermally connected to the heat-input end of the elongated member.

3. The cryogenic apparatus of claim 2, wherein said structure comprises a plate.

4. The cryogenic apparatus of claim 1, wherein the elongated member is generally frusto-conical.

5. The cryogenic apparatus of claim 1, wherein the elongated member has a substantially uniform taper.

6. The cryogenic apparatus of claim 1, wherein the elongated member is of stepped form.

7. The cryogenic apparatus of claim 1, wherein the elongated member comprises a co-axial nest of tubular elements of differing and increasing length.

8. The cryogenic apparatus of claim 1, wherein the elongated member comprises a closepacked cluster of elements.

9. The cryogenic apparatus of claim 1, wherein the elongated member is constructed from separate materials having differing thermal conductivities.

10. The cryogenic apparatus of claim 1, wherein one part of the elongated member is movable relative to another part thereof.

* * * * *